US005984420A

United States Patent [19]

Murray et al.

[11] Patent Number: 5,984,420

[45] Date of Patent: Nov. 16, 1999

[54] GRADE AVERAGING SYSTEM WITH FLOATING BOOM AND METHOD OF USING THE SAME

[75] Inventors: Stuart W. Murray, Brentwood; Scott Francis Lyons, Antioch, both of Tenn.

[73] Assignee: Wirtgen America, Inc., Nashville, Tenn.

[21] Appl. No.: 09/086,642

[22] Filed: May 29, 1998

[51] Int. Cl.[6] ..... E02F 3/76

[52] U.S. Cl. ..... 299/1.5; 172/4.5; 404/84.5; 56/10.2 E

[58] Field of Search ..... 172/4, 4.5, 7; 37/348, 37/382; 404/84.05, 84.5; 56/10.2 E; 299/1.5, 39.6

[56] References Cited

U.S. PATENT DOCUMENTS

| | | | |
|---|---|---|---|
| 3,561,538 | 2/1971 | Curlett et al. | 172/4.5 |
| 4,213,719 | 7/1980 | Swisher, Jr. et al. | 404/84.2 |
| 5,309,407 | 5/1994 | Sehr et al. | 367/96 |

OTHER PUBLICATIONS

Wirtgen America Inc., "Cold Mining Machine W1000", Oct. 1994.

*Primary Examiner*—David Bagnell
*Assistant Examiner*—Sunil Singh
*Attorney, Agent, or Firm*—Lucian Wayne Beavers Waddy & Patterson

[57] ABSTRACT

A traveling construction apparatus includes a flame having first and second ground engaging traveling gears connected to the frame and spaced apart in a direction of travel. A traveling gear height adjuster is connected between the frame and the first traveling gear. A plurality of height sensors are provided for measuring a height above the ground without engaging the ground. A height controller system is provided for actuating the traveling gear height adjuster in response to input signals from the sensors. A floating boom is connected to the frame and has the sensors mounted on the boom. The boom displaces each of the sensors a substantially equal distance relative to the ground in response to an extension or contraction of the traveling gear height adjuster.

23 Claims, 13 Drawing Sheets

GRADE AVERAGING SYSTEM WITH FLOATING BOOM AND METHOD OF USING THE SAME

BACKGROUND OF THE INVENTION

1. Field of The Invention

The present invention relates generally to systems for controlling the elevation above ground level of a tool of a road construction machine, and more particularly, but not by way of limitation, to a grade averaging system for a pavement milling machine.

2. Description of the Prior Art

It is common practice in the design of various construction apparatus, such as pavement milling machines, paving machines, curb forming machines, and the like, to provide an automatic elevation control system. The automatic elevation control system will typically measure a distance between a sensor mounted on the machine and a reference point fixed relative to the ground. The reference point may in fact be the ground surface, or it may be a guide string or the like.

The sensing system may be of the type which engages the referenced surface or it may be of a non-contact type. Sensing systems which engage the referenced surface include those using skis or rollers which traverse the ground surface, and those which include a sensor arm which engages the guide string or the like.

Those sensing systems which use non-contact sensors may use ultra sonic sensors, laser sensors, or the like.

One commonly used prior art elevation control system is that sold by Moba Electronic Gesellschaft für Mobil-Automation MbH, as is described in detail in U.S. Pat. No. 5,309,407 to Sehr, et al., the details of which are incorporated herein by reference. The Sehr, et al., system is designed for use with a milling machine which has its cutting drum mounted to a mid portion of the frame, approximately midway between its forward and rearward traveling gears. As used herein, the term "traveling gears" includes any of the conventional ground engaging means used on construction equipment, typically either wheels with rubber tires or an endless track system.

In the Sehr, et al., system, three ultra sonic elevation sensors are utilized. All three sensors are fixably mounted on the frame of the machine. One sensor is located approximately at the position of the forward traveling gear, a second sensor is located approximately adjacent the cutting drum, and the third sensor is located approximately adjacent the rear traveling gear. The three sensors are preferably equidistantly spaced. The computerized control system receives signals from each of the three sensors representative of the distance between that sensor and the reference surface. The control system averages those three signals, and uses this average signal to control the cutting depth of the cutting drum. By using an average signal taken from three different sensors, this system minimizes the undesired effect of irregularities in the road. As will be appreciated by those skilled in the art, if only a single sensor were utilized, it would try to exactly reproduce irregularities which it senses in the roadway.

It will be appreciated that with the Sehr, et al., system wherein all three sensors are fixedly attached to the frame of the machine, if one of the wheels encounters an anomaly, e.g. a hole, in the road, that anomaly will not be sensed by the sensor adjacent that traveling gear if the sensor also is located above the hole. Instead the effect will be for a portion of the anomaly to be sensed at the middle sensor adjacent the cutting drum. The sensor at the other traveling gear would also not sense any anomaly.

This system works adequately with a machine like that illustrated in Sehr, et al., for which it was designed, namely one with the cutting drum located midway between the forward and rearward traveling gears. This permits three sensors to be located approximately adjacent the forward and rear traveling gears and the cutting drum, and the average elevations sensed by those sensors is utilized to control the cutting drum in the manner just described.

There are, however, other types of commonly used construction equipment for which the system of Sehr, et al., is not operable. For example, another common design of roadway milling machine is that sold by the assignee of the present invention as the Wirtgen Model W1000 Cold Milling Machine. The Wirtgen Model W1000 machine has a pair of forward wheels and a pair of rearward wheels. The rotating cutting drum is located directly between the pair of rearward wheels. Thus, there is no longitudinal separation between the cutting drum and the rearward wheels.

The inapplicability of the Sehr, et al., system to use on a machine like the Wirtgen Model W1000 led the inventor to develop a substantially modified system which would be useable with a machine wherein the cutting drum is located directly between a pair of wheels. The result has been a grade averaging system which is much more universal in its applicability. As will be shown, the system of the present invention can be used with a machine geometry like that of the Wirtgen Model W1000 machine, and also can in fact be used with improved results upon machines having a geometry like that of the Sehr, et al., machine.

SUMMARY OF THE INVENTION

The present invention provides a floating boom pivotally mounted to the frame of the construction machine. A plurality of sensors are mounted on the floating boom. A control mechanism is provided which maintains a pre-selected angular relationship between the boom and a line of contact of the front and rear traveling gears with the ground surface. Preferably the boom is maintained parallel to this line of contact. Thus, a very different geometric relationship between the sensors and the ground surface is provided than was the case with the prior art Sehr, et al., device. With the Sehr, et al., device, a change in the pitch of the machine due to encountering a hole in the road and/or due to an adjustment in the height of the ram between the machine and one of the traveling gears, cause differing changes in the sensed elevation at each of the three sensing points. With the floating boom of the present invention, however, any change in the extension of the ram connected to the traveling gear is equally transmitted to all three of the sensors, because all three sensors are maintained at a common elevation relative to the line of contact of the traveling gears of the ground.

In a preferred embodiment, the present invention provides a traveling construction apparatus which includes a frame and a first and second ground engaging traveling gears connected to the frame and engaging the ground at first and second locations which define an imaginary line of ground contact in a direction of travel of the construction apparatus.

A traveling gear height adjustment means is connected between the frame and the first traveling gear for adjusting a distance between the frame and the first traveling gear. An elongated boom is pivotally connected to the frame at a pivot point and extending in the direction of travel. A boom orientation control means is provided for maintaining a selected (preferably parallel) angular orientation of the boom relative to the line of ground contact.

A sensor means, preferably three spaced ultra sonic sensors, is mounted on the boom for generating an input signal representative of a distance from the sensor means to the ground without contacting the ground.

A height control means is provided for actuating the traveling gear height adjustment means in response to the input signal from the sensor.

A variety of different boom orientation control means are disclosed. One preferred embodiment is the use of a cable having a first end fixed relative to the first traveling gear and a second end fixed relative to the frame. The cable is received through a cable housing which is connected to the boom.

Another form of boom orientation control means is a mechanical linkage.

Another form of boom orientation control means includes an electro-mechanical orientation sensor and orientation controller.

Still another form of boom orientation control means includes a closed hydraulic loop having a first hydraulic cylinder between the frame and the first traveling gear, and a second hydraulic cylinder between the frame and the boom.

With the floating boom of the present invention, it is not necessary that the sensors be equidistantly spaced.

The floating boom may be generally described as a floating boom means connected to the frame and having the sensors mounted on the boom for displacing each of the sensors an equal distance relative to the ground in response to an extension or contraction of the traveling gear height adjuster.

The boom orientation control means may also be described as a means for maintaining a selected angular orientation of the boom relative to a line of ground contact or relative to a line between axes of rotation of the first and second traveling gears, regardless of the pitch of the construction apparatus relative to the ground.

Methods of controlling the height of a working tool of a traveling construction machine are also provided.

Thus, it is an object of the present invention to provide a traveling construction apparatus having an automatic leveling system.

Another object of the present invention is the provision of a traveling construction machine having an automatic leveling system, including a plurality of elevation sensors, which system averages the signals from the sensors.

Still another object of the present invention is the provision of a traveling construction apparatus having a plurality of elevation sensors mounted upon a floating boom.

Yet another object of the present invention is the provision of an automatic leveling system suitable for use upon a pavement milling machine which has its cutting drum located directly between a pair of wheels.

Still another object of the present invention is the provision of a traveling construction apparatus having an automatic leveling system including a plurality of sensors, and including a means for displacing each of the sensors an equal distance relative to the ground in response to an extension or contraction of a traveling gear height adjuster.

Still another object of the present invention is the provision of a traveling construction apparatus having an elongated boom pivotally attached to the apparatus and carrying a plurality of sensors, and including a boom orientation control means for maintaining a selected angular orientation of the boom relative to a line of ground contact regardless of the pitch of the construction apparatus relative to the ground.

Still another object of the present invention is the provision of methods of controlling the height of a working tool of a traveling construction machine relative to an irregular ground surface, wherein upon adjustment of the height of the frame, an equal adjustment in the height of each of a plurality of height sensors relative to a ground surface is made.

Numerous other objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 3, the machine is shown with the frame oriented parallel to the reference ground surface upon which the wheels sit. The embodiment shown in FIG. 3 includes a cable type boom orientation control means.

In FIG. 12 the three sensors are mounted in approximately the same longitudinal locations as they were in the Sehr, et al., patent, except for the fact that the sensors are now mounted on a floating boom. FIG. 13 shows a special floating location wherein one sensor is located above the cutting drum, and the other two sensors are located in front of and behind the forward traveling gear. FIG. 14 illustrates a spread location wherein the forward most and rearward most sensors have been extended beyond the longitudinal position of the traveling gears.

DETAILED DESCRIPTION OF THE PREFERRED EMBODIMENTS

Figure 1:
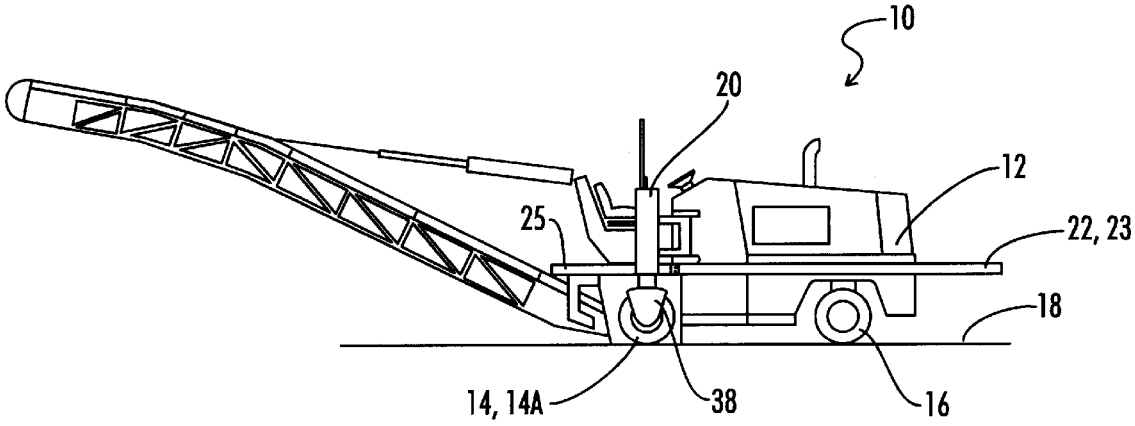
FIG. 1 is a right side elevation view of a pavement milling machine, including the floating boom level control system of the present invention.
Figure 2:
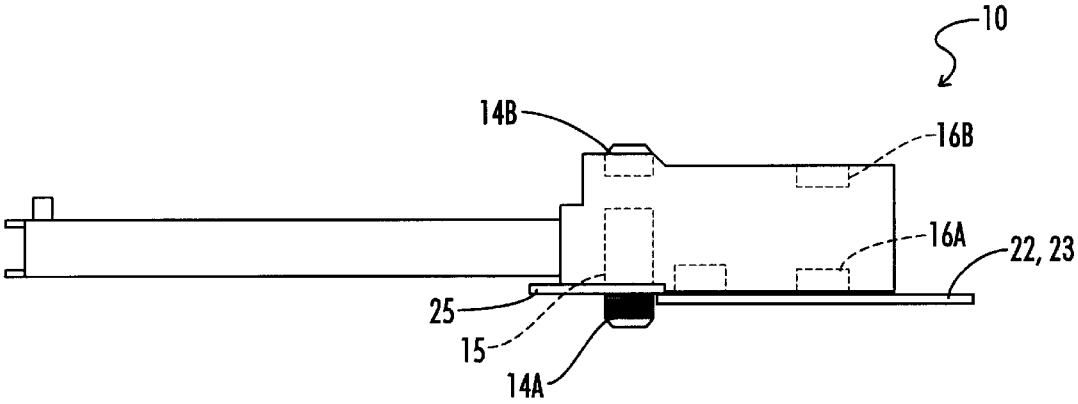
FIG. 2 is a schematic top plan view of the machine of FIG. 1.

Turning now to the drawings, and particularly to FIGS. 1 and 2, a pavement milling machine is there shown and generally designated by the numeral 10. The machine 10 may be more generally described as a traveling construction apparatus 10. It will be appreciated that the apparatus 10 can be any type of construction apparatus, including for example, pavement milling machines, paving machines, curb forming machines, and the like.

FIG. 1 is a right side elevation view of the apparatus 10 which is constructed for forward movement in a direction to the right in FIG. 1.

The apparatus 10 includes a frame 12 and first and second ground engaging traveling gears 14 and 16. Thus, in the machine 10, the first traveling gear 14 is the rear traveling gear and the second traveling gear 16 is the front traveling gear.

In the embodiment illustrated in FIGS. 1 and 2, the first traveling gear 14 is made up of a pair of transversely spaced rear wheels 14A and 14B, spaced apart transversely to the direction of travel of the apparatus 10. The second traveling gear 16 is made up of a pair of transversely spaced front wheels 16A and 16B. Wheels 14 and 16 have axes of rotation 36 and 37, respectively.

It will be appreciated that other types of traveling gears other than rubber tired wheels may be utilized. For example, the traveling gears can be self-propelled tracks.

A rotatable cutting drum 15 is rotatably attached to the frame 12 and located transversely between the wheels 14A and 14B.

As seen in FIG. 1, the rear and front wheels 14 and 16 engage a ground surface 18 and define an imaginary line of ground contact 18 in a direction of travel of the construction apparatus 10.

A traveling gear height adjustment means 20, which in a preferred embodiment includes a pair of hydraulic rams associated with the rear wheels 14A and 14B, is connected between the frame 12 and the rear wheels 14A and 14B for adjusting a distance between the frame 12 and the rear wheels 14A and 14B. This also adjusts the elevation of the frame 12 above the ground surface 18.

Although the apparatus shown in FIGS. 1 through 4 only has rams above the rear wheels 14, the invention is equally applicable to such an apparatus including rams for adjusting the height of both the front and rear wheels.

Figure 3:
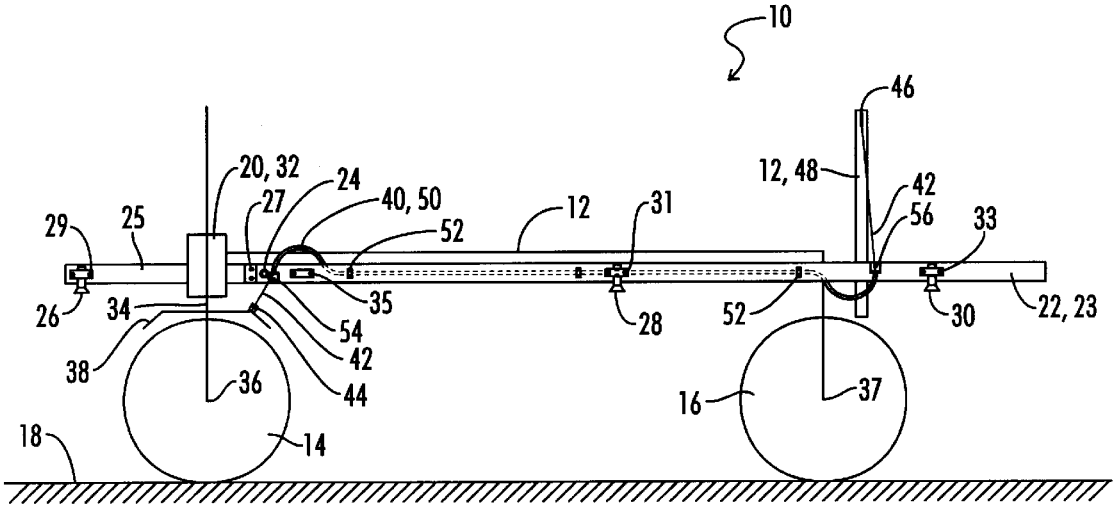
FIG. 3 is a schematic right side elevation view of the machine in FIG. 1 illustrating the details of the floating boom level control system.

An elongated boom 22 is pivotally connected to frame 12 at a pivot point 24, best seen in FIG. 3. The boom 22 extends generally in the direction of travel from left to right as seen in FIGS. 1–4.

The boom 22 is comprised of a main boom portion 23 and a rearward boom extension 25. The rearward boom extension 25 is constructed to fit around and not interfere with the ram 20, and is connected to the main boom 23 by connectors 27.

First, second and third sensors 26, 28 and 30, are mounted upon the boom 22 with mounting pads 29, 31 and 33, respectively. A fourth mounting pad 35 provides an alternative location for sensor 26 if boom expansion 25 is not used. The sensors provide a means for generating an input signal representative of a distance from each of the respective sensors to the ground surface 18 without contacting the ground surface 18. The sensors 26, 28 and 30 are preferably ultra-sonic sensors. They may also be lasers sensors or any other form of non-contact sensor.

The hydraulic ram 20 includes an outer cylinder 32 having a piston 34 extending downward therefrom and rotatably connected to wheel 14A at axis of rotation 36. A fender 38 is fixedly mounted relative to wheel 14A so as to move vertically up and down relative to frame 12 with the wheel 14A and piston 34. An identical second ram is associated with wheel 14B. The two rams act simultaneously to raise and lower frame 12 relative to wheels 14A and 14B.

The apparatus 10 includes a boom orientation control means 40 for maintaining a selected angular orientation of the boom 22 about pivot point 24 relative to the line of ground contact 18. The boom orientation control means 40 includes a cable 42 having a first end 44 fixedly attached to the fender 38 of first traveling gear 14, and having a second end 46 fixedly attached to a vertical post 48 extending upward from and fixed relative to the frame 12. Post 48 may be considered to be part of frame 12. Post 48 is attached to frame 12 with clamps 49 and 51.

The boom orientation control means 40 includes a cable housing 50 connected to the boom 22 with clamps such as 52. The cable 42 is received through the cable housing 50 and its first and second ends 44 and 46 extend out of the cable housing 50.

First and second cable free play adjusters 54 and 56 are connected between the cable 42 and the cable housing 50 at each end of the cable housing 50.

The cable free play adjusters 54 and 56 utilize a threaded adjustment on the housing similar to that utilized on bicycle or motorcycle control cable.

The boom orientation adjustment means 40 works in the following manner. With the apparatus 10 resting upon a flat surface 18, with the frame 12 oriented substantially parallel to the flat surface 18, the cable free play adjusters 54 and 56 are adjusted to pivot boom 22 about pivot point 24 until the boom 22 is also substantially parallel to the flat surface 18. Also, the clamps 49 and 51 may be loosened and the height of post 48 may be adjusted to adjust the initial position of boom 22.

Figure 4:
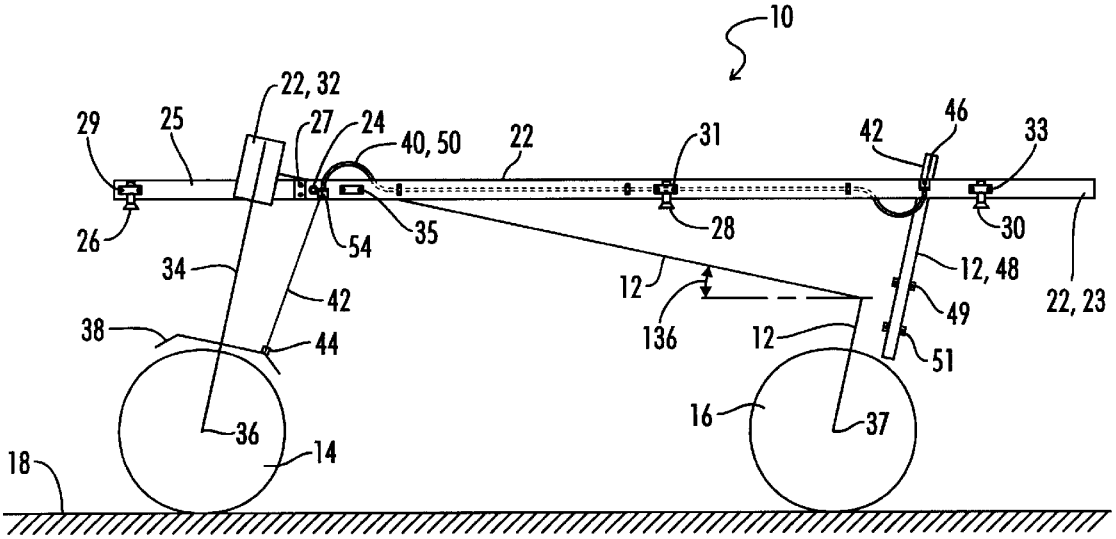
FIG. 4 is a schematic view similar to FIG. 3 but illustrating the situation wherein the pitch of the frame has been changed relative to the ground surface, and wherein the floating boom is maintained parallel to the ground surface.

Then, when the ram 20 is extended as shown in FIG. 4 to change the pitch angle 136 of the frame 12 relative to the surface 18, more of the cable 42 will pull out of the cable housing 50 adjacent the first end 44 of cable 42 thus pulling the right hand end of boom 22 upward along the cable 42 closer to the second end 46 of cable 42, thus maintaining the boom 22 parallel to the ground surface 18 as seen in FIG. 4.

Figure 5:
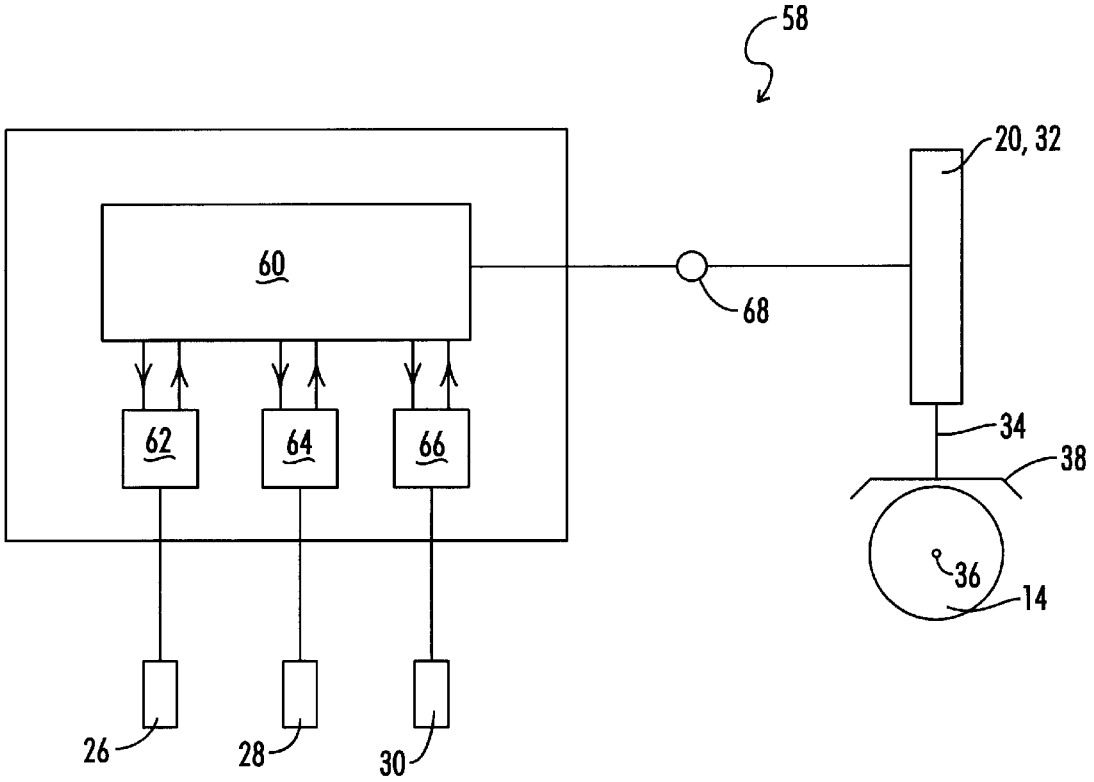
FIG. 5 is a schematic illustration of the electronic height control system which takes the inputs from the elevation sensors and uses them to control the extension of a hydraulic ram connected to the rear traveling gear of the machine of FIGS. 1–4.

FIG. 5 schematically illustrates a height control means 58 for actuating the ram 20 in response to input signals from the sensors 26, 28 and 30. The control means 58 may be a Moba Part No. 040101025, manufactured by Moba Electronic Gesellschaft für Mobil-Automation mbH and available from AGL Company in Jacksonville, Ark., control system of the type disclosed and described with regard to FIG. 2 of U.S. Pat. No. 5,309,407 to Sehr, et al., the details of which are incorporated herein by reference. The sensors 26, 28 and 30 are connected to a computing unit 60 via transmitting and receiving circuit 62, 64 and 66. The computing unit 60 provides a control signal to an electronically controlled hydraulic valve 68 for operating the ram 20 to control extension and contraction of piston 34 of ram 20.

The height control means 58 is, as described in the Sehr, et al. patent, one that is responsive to an average of the distance from each of the plurality of sensors 26, 28 and 30 to the ground surface 18.

As will be further described below, the apparatus 10 preferably includes at least two sensors, and even more preferably, at least three sensors, but some of the advantages of the present invention can be obtained even with the use of a single sensor on a pivoting boom 22. Furthermore, when at least three sensors are used, it is not necessary with the present invention to have equal spacing between the sensors and there can in fact be unequal spacing between the sensors.

With the system of the present invention wherein the boom causes all the sensors to raise or lower by substantially the same distance when there is an adjustment made to the pitch of the frame relative to the ground surface, there are no absolute proper positions for the sensors. The sensors can be located at various positions for various reasons. For example, if the roadway has long rolling bumps, it may be desirable to put the sensors on boom extensions to increase the separation between the three sensed locations.

The apparatus 10, and particularly the floating boom 22 and height control means 58, generally operates in the following manner.

Figure 6:
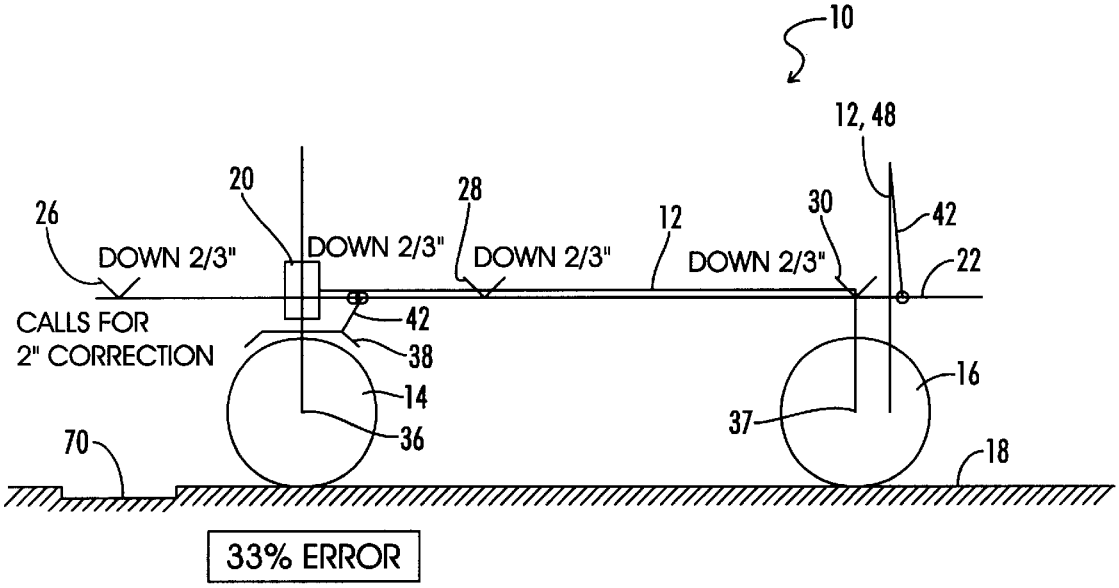
FIGS. 6 through 11 are a series of similar schematic illustrations which represent the various possible road anomalies which can be encountered by one of the wheels and/or one of the sensors, and shows the percentage of possible error in elevation which is transmitted to the cutting drum for a machine having a geometry like that shown in FIGS. 1–4.
Figure 7:
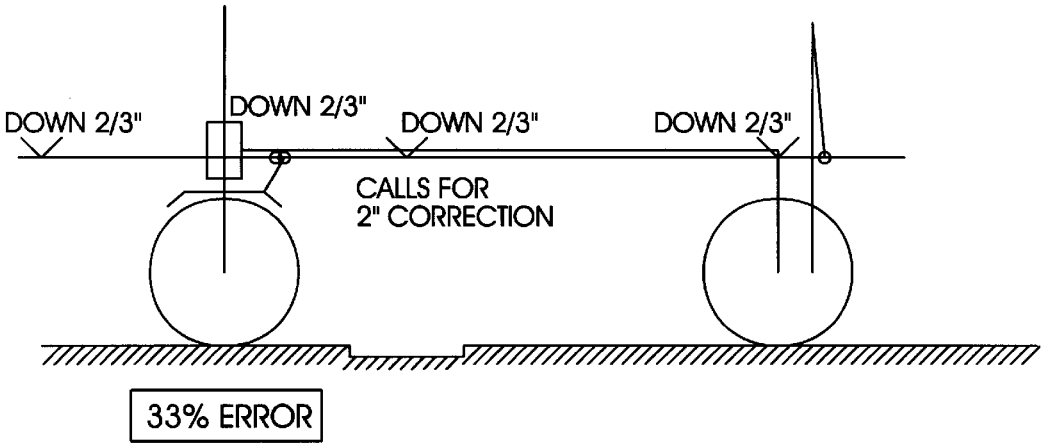
Figure 8:
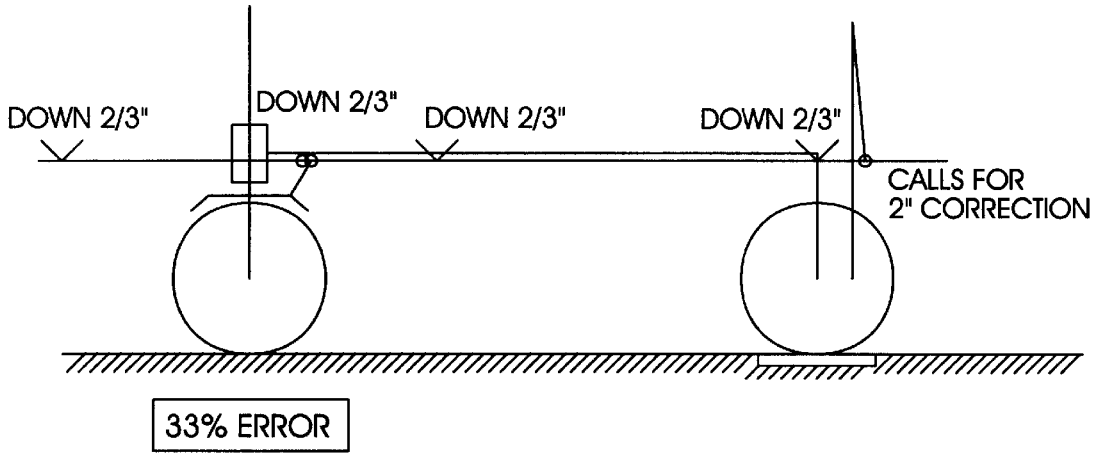
Figure 9:
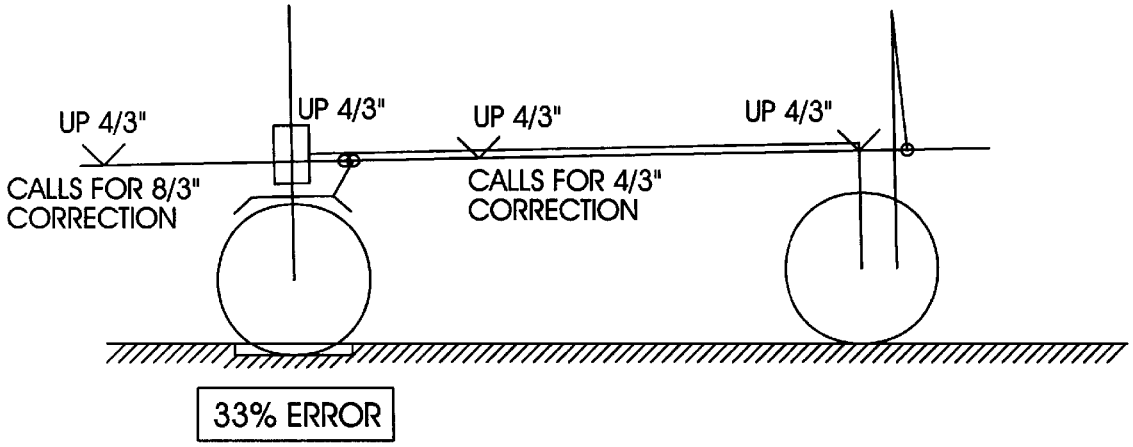
Figure 10:
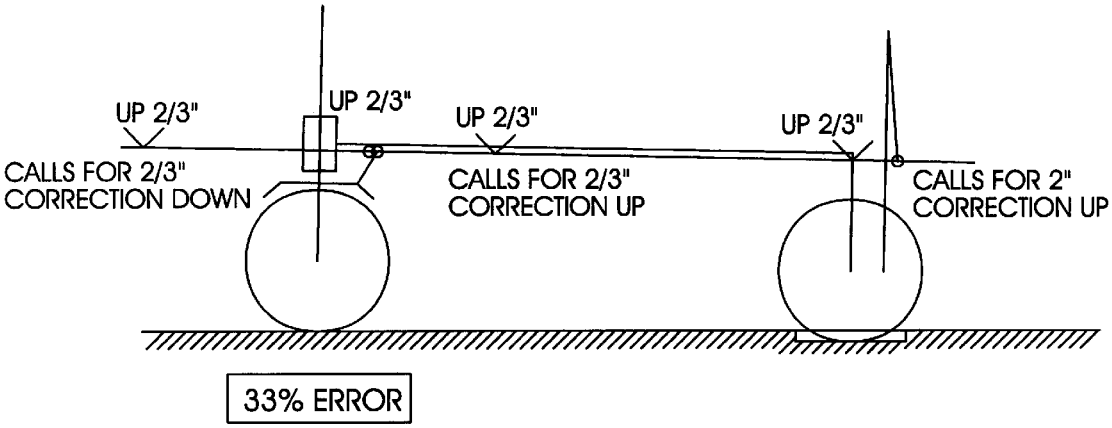
Figure 11:
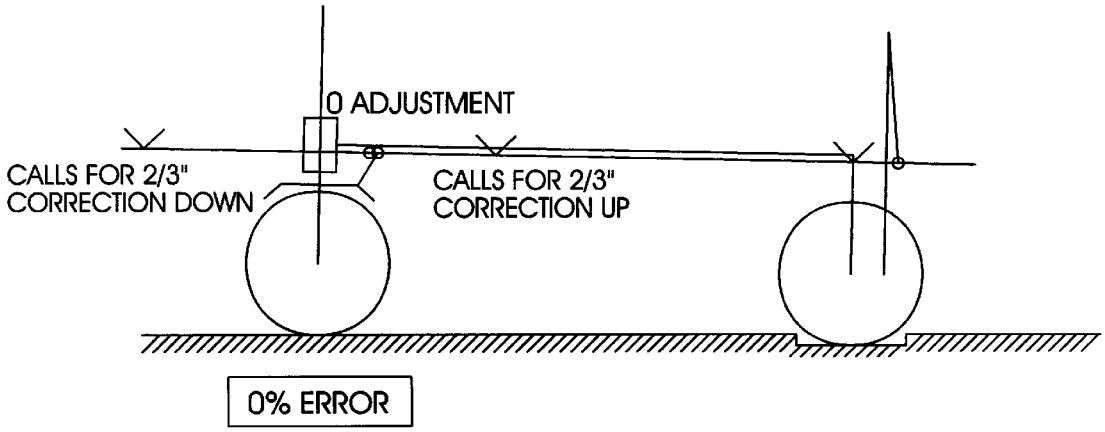

For example, FIG. 6 schematically illustrates the situation where the ground surface 18 is an irregular ground surface 18 and includes a hole 70 which at the moment in time shown in FIG. 6 is located below the first sensor 26. The hole 70 is assumed to be 2" deep, and thus when the sensor 26 passes over hole 70, it will sense a distance 2" greater that it was sensing when it was above the regular flat surface. Because the height control means 58 works on an average of the signals from the three sensors 26, 28 and 30, the average distance will change by ⅔", thus causing a signal to be sent to the ram 20 causing it to contract by ⅔", thus lowering the cutting drum 15⅔" deeper into the surface 18. The boom 22 will simultaneous pivot about its pivot point 24 so that the height of each of the sensors 26, 28 and 30 is adjusted downward by ⅔" as the ram 20 contracts ⅔". Thus, the height of each of the sensors relative to the ground surface 18 or other reference line is adjusted by a distance equal to the adjustment in height of the frame 12 relative to the first traveling gear 14. This maintains a constant angular orientation of the boom 22 relative to the reference line 18.

Although the reference line with regard to which the boom 22 is oriented has been described so far as a line of ground contact defined between the points of contact of wheels 14 and 16 with the ground surface 18, it will be appreciated that there are other possible lines of reference. For example, the boom 22 could be oriented relative to a line between the axes rotation 36 and 37 of wheels 14 and 16. Similarly, if the traveling gears 14 and 16 are tracks rather than wheels, they too will have a central point analogous to an axis of rotation.

In the example of FIG. 6 wherein there is a hole only under the rear sensor, only ⅓ or 33%, of the total potential error caused by the presence of the hole 70 is transmitted to the ram 20.

FIGS. 7, 8, 9, 10 and 11 are similar to FIG. 6 and schematically illustrate other potential locations for holes in the ground surface 18. The figures are labeled to indicate whether the hole is under a sensor, a wheel, or both. In each case the hole which is schematically illustrated is assumed to be a 2" deep hole, and in each case all three sensors are moved through an equal distance which is described in the drawings. Also, each figure is labeled to indicate the percentage of potential error which is transmitted to the ram 20.

Figure 12:
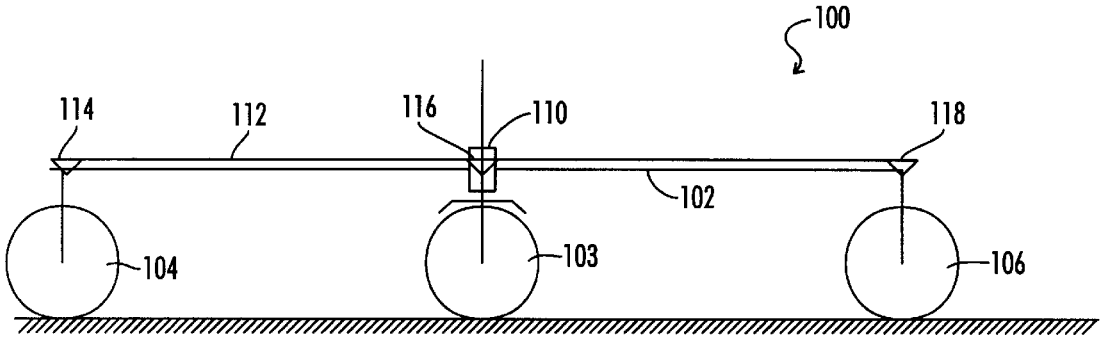
FIGS. 12, 13 and 14 schematically illustrate the manner in which a floating boom mounted level control system of the present invention can be utilized with a machine geometry like that of the Sehr., et al., patent wherein the cutting drum is mounted on the frame midway between forward and rearward traveling gears.
Figure 13:
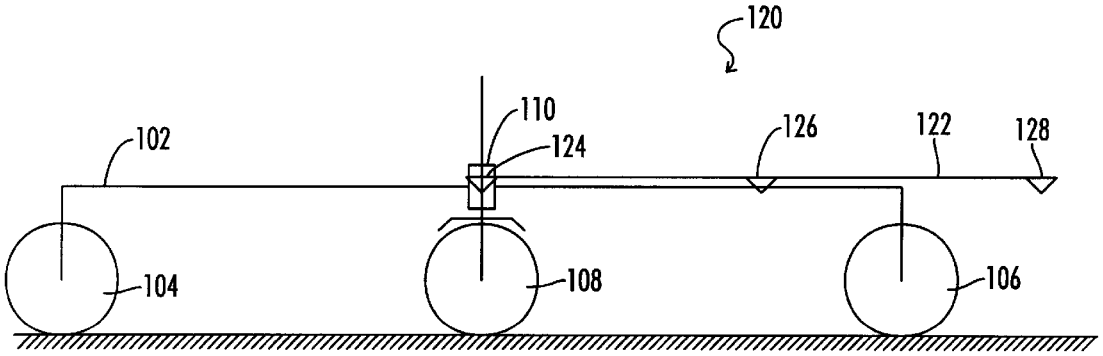
Figure 14:
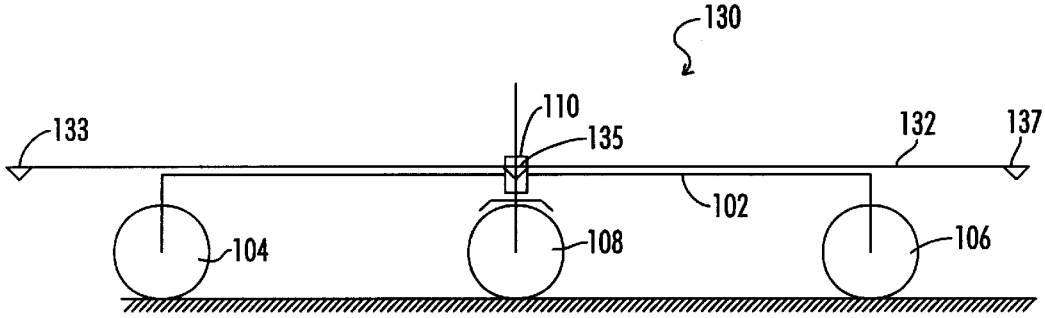
Figure 15:
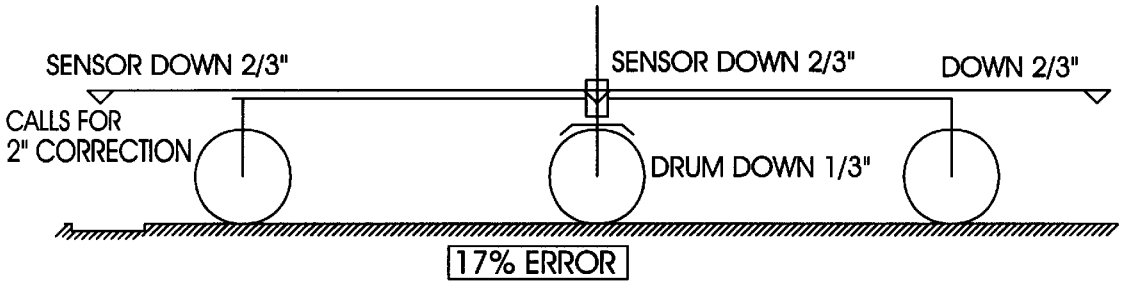
FIGS. 15 through 19 illustrate the potential error with the embodiment of FIG. 14 when encountering various conditions of a hole located under one of the wheels or the drum and/or one of the sensors.
Figure 16:
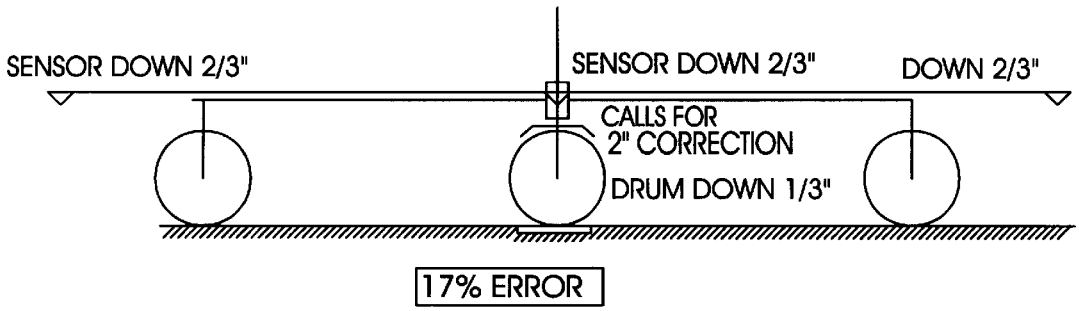
Figure 17:
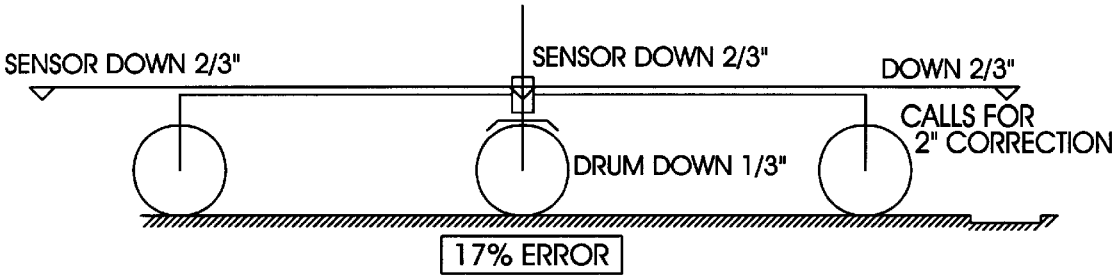
Figure 18:
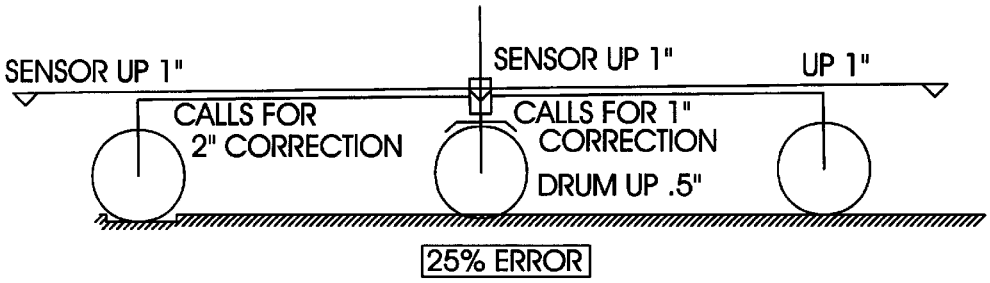
Figure 19:
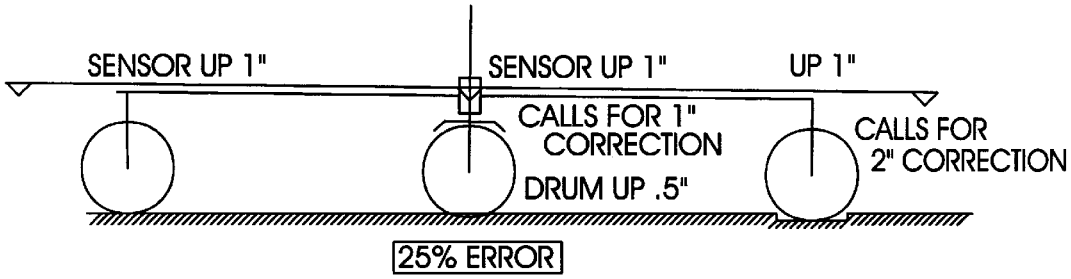

Application of the Present Invention to a Machine having the Cutting Drum Located Midway Between the Front and Rear Wheels FIGS. 12, 13 and 14 schematically illustrate three alternative arrangements by which the improved level control system of the present invention could be utilized with a road milling machine having a geometry like that of the Sehr, et al., U.S. Pat. No. 5,309,407 wherein the cutting drum is located midway between the front and rear wheels.

In FIG. 12 this alternative apparatus is shown and generally designated by the numeral 100. The apparatus 100 includes a frame 102 having rear wheels 104 and front wheels 106. A cutting drum 108 is suspended from frame 102. In this schematic illustration the change in position of cutting drum 108 relative to frame 102 is accomplished by a ram 110. It will be appreciated, however, that the movement of cutting drum 108 could also be accomplished by placement of the rams at one or both of the wheels 104 and 106.

A boom 112 is pivotally attached to frame 102. Boom 112 carries first, second and third sensors 114, 116 and 118 located adjacent the rear wheels 104, cutting drum 108 and front wheels 106, respectively.

FIG. 13 illustrates another alternative arrangement of an apparatus generally designated by the numeral 120. In this embodiment, the frame 102, wheels 104 and 106, cutting drum 108 and ram 110 are shown the same as in FIG. 12. The difference is a modified boom 122 which extends forward from a point above cutting drum 108 to a position forward of front wheels 106. The boom 122 carries three sensors, 124, 126 and 128. The sensor 124 is located adjacent the cutting drum 108. Sensors 126 and 128 are located behind and ahead of the front wheel 106, respectively.

FIG. 14 represents yet another alternative arrangement of a road construction apparatus generally designated by the numeral 130. Again, in apparatus 130, the wheels 104 and 106, cutting drum 108, and frame 102 and ram 110 are substantially similar to that shown in FIG. 12 and are represented by the same numerals.

A modified boom 132 is pivotally connected to frame 102 and extends both forward and rearward from the front wheels 106 and rear wheels 104. Boom 132 carries first, second and third sensors 133, 135 and 137. Sensor 133 is located rearward of rear wheels 104. Sensor 135 is located above cutting drum 108. Sensor 137 is located forward of front wheels 106.

The arrangement of FIG. 14 is believed to be the preferred configuration for use with an apparatus having the cutting drum 108 located midway between the front and rear wheels 106 and 104.

FIGS. 16 through 19 schematically illustrate the various conditions under which the apparatus 130 of FIG. 14 may encounter a 2" hole in the ground surface. FIGS. 16 through 19 show the various adjustments which would be made in the height of the drum and sensors, also showing the percentage of possible error which is transmitted to the drum 108. It is noted that in all of the situations represented in FIGS. 15 through 19, the maximum error that is transmitted is 25%, and in most cases, only 17% error is transmitted. This is contrasted to the 33% error which would normally be encountered in most of these situations when using the system of Sehr, et al., with the sensors fixedly attached to the frame as shown in U.S. Pat. No. 5,309,407.

Alternative Means of Controlling the Orientation of the Pivoted Boom

FIGS. 20 through 23 illustrate several alternative arrangements by which the boom can be mounted to the frame to pivot relative thereto. These may be substituted for the cable type boom orientation control means 40 previously described with regard to FIGS. 3 and 4.

Figure 20:
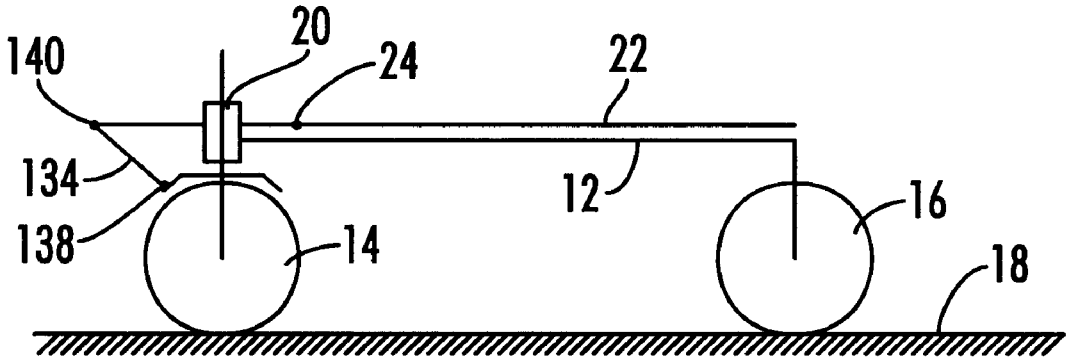
FIGS. 20 and 21 are similar to FIGS. 3 and 4 and illustrate the machine geometry of the machine of FIGS. 1–4 using an alternative form of boom orientation control means including a mechanical linkage.
Figure 21:
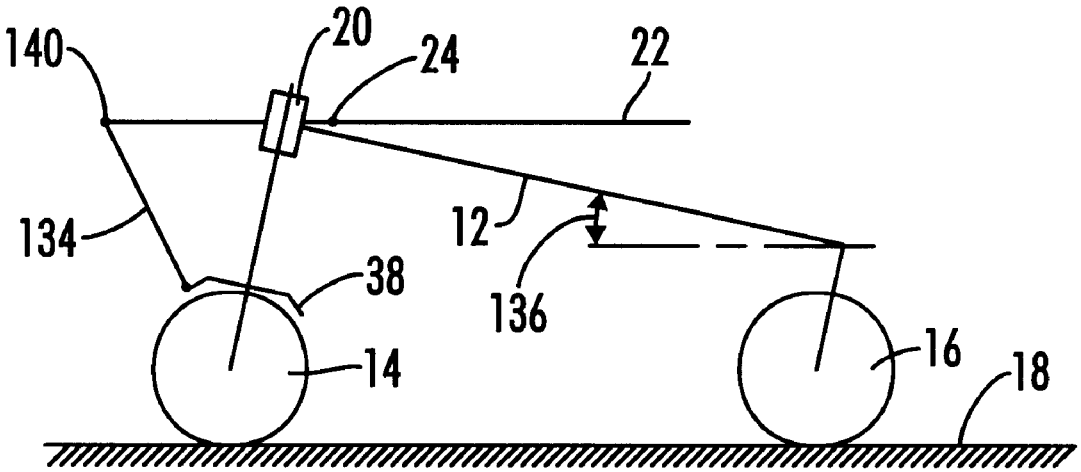

FIGS. 20 and 21 illustrate a mechanical linkage 134 connecting the boom 22 to the frame 12 and the first traveling gear 14. In FIG. 20, the apparatus is shown with the frame 12 located substantially parallel to the ground surface 18.

In FIG. 21, the ram 20 has been extended so as to substantially change the pitch angle 136 of frame 12 relative to ground surface 18. The mechanical linkage 134 which is pivotally attached to fender 38 at pivot point 138 and to a rearward portion of boom 22 at pivot point 140, has caused the boom 22 to pivot about pivot point 24 relative to the frame 12 so that the boom 22 is maintained substantially parallel to ground surface 18 as seen in FIG. 22.

With the embodiment of FIGS. 20 and 21, the linkage 134 can be designed which keeps the boom approximately level within the relatively small (approximately 10°) maximum range of motion of the boom 22 about its pivot point 24 in a typical operation.

Figure 22:
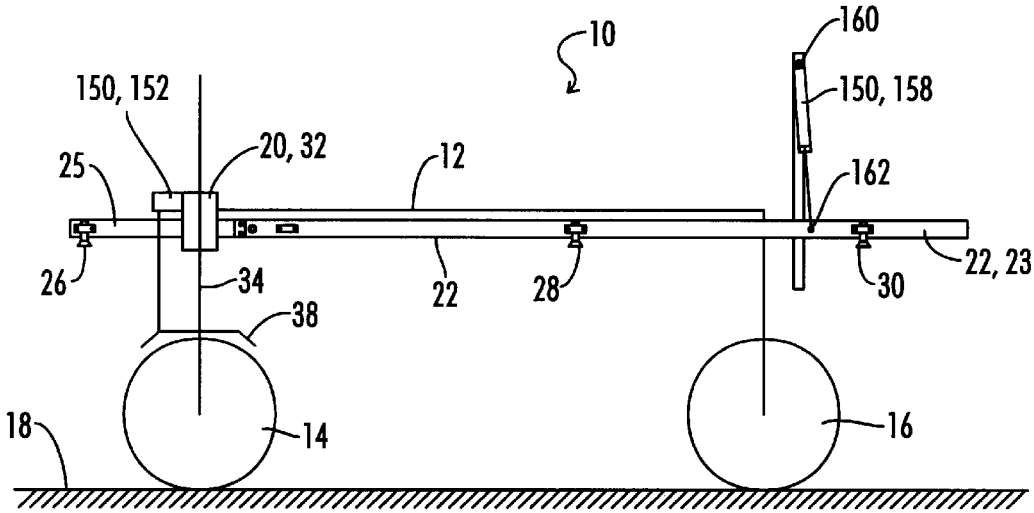
FIGS. 22–23 are similar to FIGS. 3 and 4 and illustrate another alternative of boom orientation control means including an electro-mechanical sensor and an electro-mechanical orientation controller.
Figure 23:
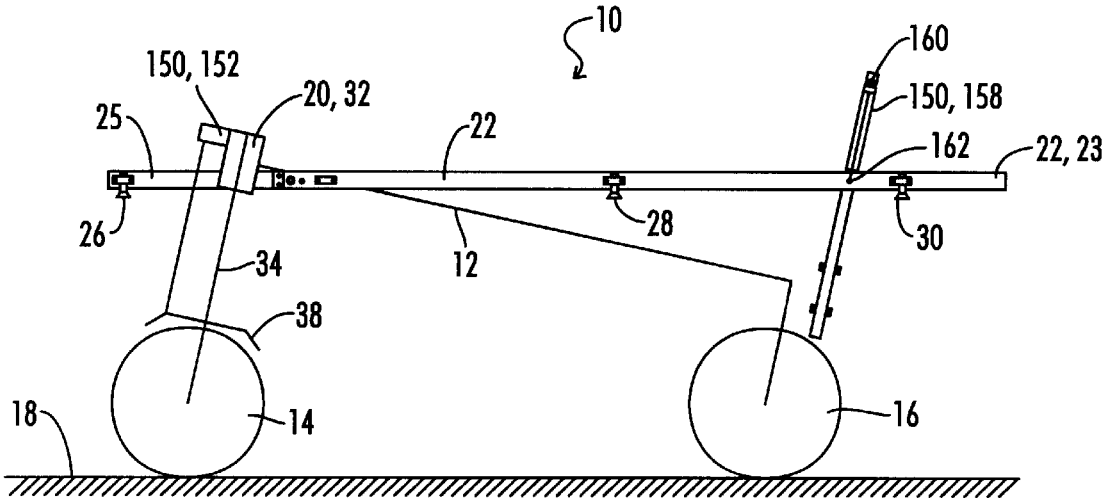
Figure 24:
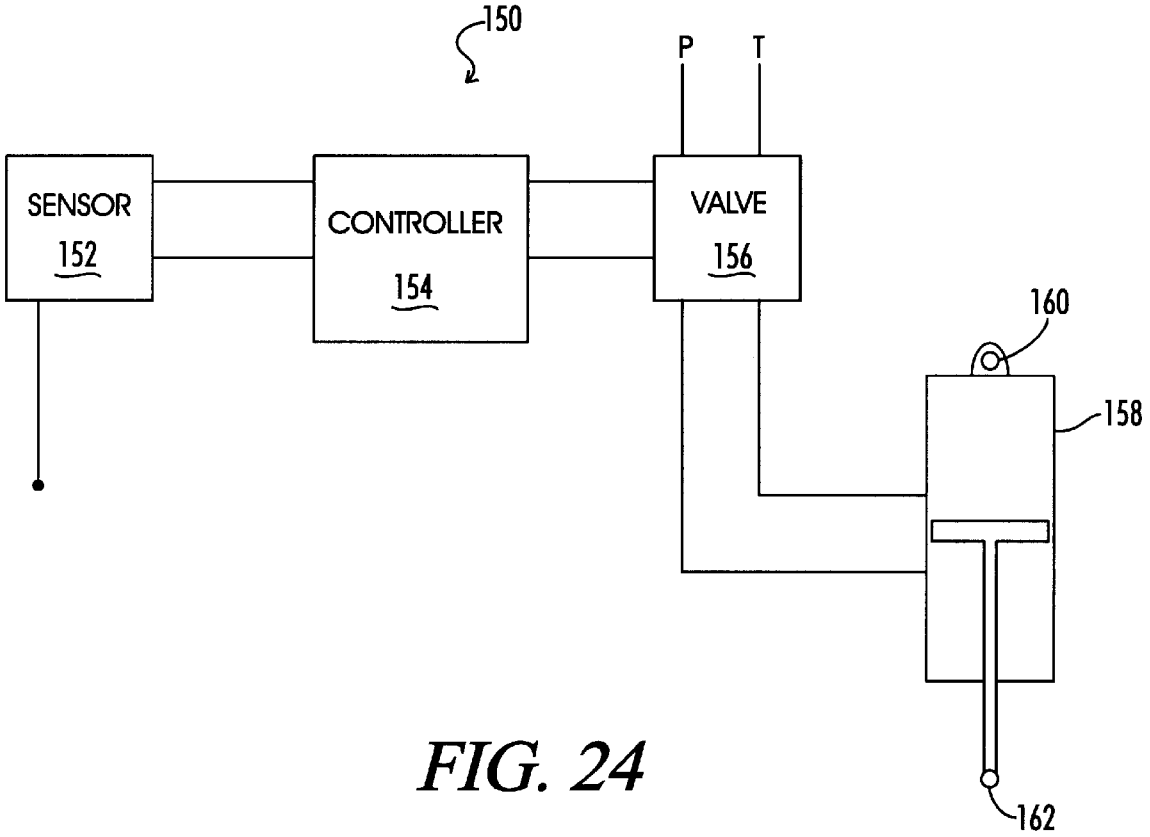
FIG. 24 is a schematic illustration of the boom orientation control means of FIGS. 22–23.

FIGS. 22–24 illustrate a boom orientation control means 150 which includes an electro-mechanical sensor 152. Sensor 152 may be a rope sensor or any type of linear displacement transducer which senses actuation of the rams 20. A signal from sensor 150 goes to electronic controller 154 which sends a control signal to electrically controlled hydraulic valve 156. Valve 156 controls a hydraulic cylinder 158 which is connected at one end 160 to post 48, and at the other end 162 to boom 22 to control the position of boom 22.

Figure 25:
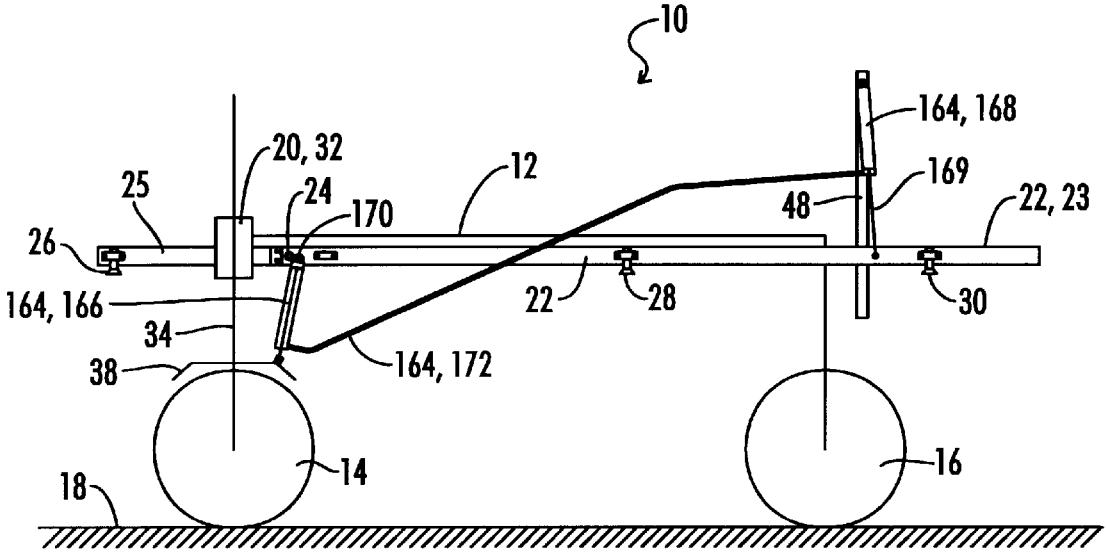
FIGS. 25 and 26 are similar to FIGS. 3 and 4 and illustrate still another alternative embodiment of boom orientation control means including a closed hydraulic system.
Figure 26:
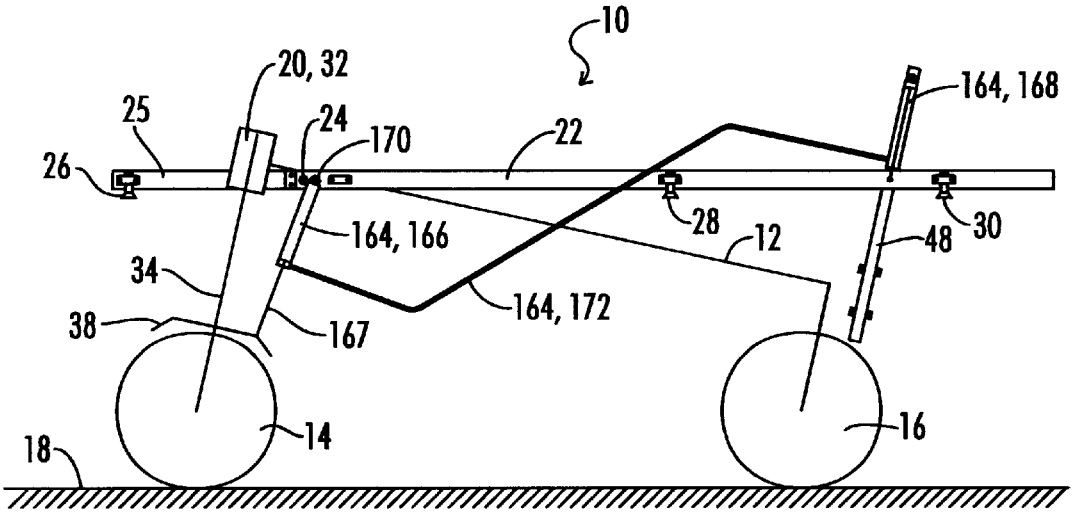

FIGS. 25 and 26 illustrate another alternative boom orientation control means 164 which is a closed hydraulic system including a first hydraulic cylinder 166 connected between frame 12 and first traveling gear 14, and a second hydraulic cylinder 168 connected between frame 12 and boom 22. It is noted that in the embodiment shown, the upper end 170 of first hydraulic cylinder 166 is actually connected to boom 22 near pivot point 24. Thus, the upper end 170 of cylinder 166 has little movement relative to frame 12.

When the piston 167 of first cylinder 166 is extended to the position of FIG. 26 by extension of ram 22, hydraulic fluid is displaced from cylinder 166 through hydraulic hose 172 to cylinder 168. This causes retraction of the piston 169 of second cylinder 168, thus pivoting the boom 22 to maintain it parallel to ground surface 18. Similarly, when ram 20 retracts, the piston 167 is pushed back into cylinder 166 thus drawing hydraulic fluid through the hose 172 to once again extend the piston 169 of second cylinder 168.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in art, which changes are encompassed within the scope and spirit of the present invention as defined by the appended claims.

What is claimed is:

1. A traveling construction apparatus, comprising:

a frame;

first and second ground engaging traveling gears connected to the frame and engaging the ground at first and second locations which define an imaginary line of ground contact in a direction of travel of the construction apparatus;

traveling gear height adjustment means, connected between the frame and the first traveling gear, for adjusting a distance between the frame and the first traveling gear;

an elongated boom pivotally connected to the flame at a pivot point and extending in the direction of travel;

boom orientation control means for maintaining a selected angular orientation of the boom relative to the line of ground contact;

a sensor means, mounted on the boom, for generating an input signal representative of a distance from the sensor means to the ground without contacting the ground; and height control means for actuating the traveling gear height adjustment means in response to the input signal from the sensor.

2. The apparatus of claim 1, wherein:

the first traveling gear includes a first pair of transversely spaced traveling gears spaced apart transversely to the direction of travel of the construction apparatus; and the apparatus further comprising a rotatable cutting drum attached to the frame and located between the first pair of traveling gears.

3. The apparatus of claim 2, wherein the first pair of transversely spaced traveling gears includes a first pair of wheels.

4. The apparatus of claim 2, wherein the traveling gear height adjustment means includes a first pair of rams connected between the frame and the first pair of transversely spaced traveling gears.

5. The apparatus of claim 1, wherein the boom orientation control means comprises:

a cable having a first end fixed relative to the first traveling gear and a second end fixed relative to the frame; and a cable housing connected to the boom and having the cable received through the cable housing with the first and second ends of the cable extending from the cable housing.

6. The apparatus of claim 5, further comprising:

a cable free play adjuster attached to the cable housing.

7. The apparatus of claim 1, wherein the boom orientation control means comprises a mechanical linkage connecting the boom to the first traveling gear.

8. The apparatus of claim 1, wherein the boom orientation control means includes an electro-mechanical orientation sensor and orientation controller.

9. The apparatus of claim 1, wherein the boom orientation control means includes a closed hydraulic system having a first hydraulic cylinder connected to the first traveling gear and a second hydraulic cylinder connected between the frame and the boom.

10. The apparatus of claim 1, wherein:

the sensor means includes at least two sensors spaced along the boom; and the height control means is responsive to an average of the distances from the sensors to the ground.

11. The apparatus of claim 10, wherein the sensor means includes at least three sensors spaced along the boom.

12. The apparatus of claim 11, wherein sequential spacing between adjacent sensors is unequal.

13. The apparatus of claim 10, wherein the sensors are ultrasonic sensors.

14. The apparatus of claim 1, wherein the selected angular orientation comprises the boom being parallel to the line of ground contact.

15. A traveling construction apparatus, comprising:

a frame;

first and second ground engaging traveling gears connected to the frame and spaced apart in a direction of travel;

a traveling gear height adjuster connected between the frame and the first traveling gear;

a plurality of height sensors for measuring a height above the ground without engaging the ground;

height control means for actuating the traveling gear height adjuster in response to input signals from the sensors; and floating boom means, connected to the frame and having the sensors mounted on the floating boom means, for displacing each of the sensors an equal distance relative to the ground in response to an extension or contraction of the traveling gear height adjuster.

16. The apparatus of claim 15, wherein the floating boom means includes:

an elongated boom extending in a direction of travel of the apparatus; and boom orientation control means for maintaining a selected angular orientation of the boom relative to a line between axes of rotation of the first and second traveling gears regardless of the pitch of the construction apparatus relative to the ground.

17. The apparatus of claim 15, wherein the floating boom means comprises:

a boom pivotally connected to the frame;

a cable housing connected to the boom; and a cable extending through the cable housing and having a first end fixed relative to the first traveling gear and a second end fixed relative to the frame so that when the first traveling gear is extended relative to the frame, the boom is pivoted relative to the frame so as to maintain an angular orientation of the boom relative to a line between axes of rotation of the first and second traveling gears.

18. The apparatus of claim 15, wherein the floating boom means comprises:

a boom pivotally connected to the frame; and a mechanical linkage connecting the boom to the first traveling gear so that when the first traveling gear is extended relative to the frame, the boom is pivoted relative to the frame so as to maintain an angular orientation of the boom relative to a line between axes of rotation of the first and second traveling gears.

19. The apparatus of claim 15, wherein the floating boom means comprises:

an elongated boom; and electro-mechanical orientation sensor and control means for maintaining an angular orientation of the boom relative to a line between axes of rotation of the first and second traveling gears.

20. The apparatus of claim 15, wherein the floating boom means comprises:

a boom pivotally connected to the frame; and a closed hydraulic system having a first hydraulic cylinder connected to the first traveling gear and a second hydraulic cylinder between the frame and the boom so that when the first traveling gear is extended relative to the frame, the boom is pivoted relative to the frame so as to maintain an angular orientation of the boom relative to a line between axes of rotation of the first and second traveling gears.

21. A method of controlling a height of a working tool of a traveling construction machine relative to an irregular ground surface, the construction machine having first and second traveling gears supported from a frame and spaced apart in a direction of travel of the machine, the method comprising:

(a) traversing the ground surface with the construction machine in the direction of travel;

(b) sensing a height above the ground surface with each of a plurality of height sensors spaced apart in the direction of travel, each height sensor generating an input signal;

(c) averaging the input signals from all of the height sensors;

(d) adjusting a height of the frame and thereby of the working tool relative to the first traveling gear in response to the average of the input signals, thereby changing a pitch of the frame relative to an imaginary reference line between areas of ground contact of the first and second traveling gears; and (e) adjusting a height of each of the height sensors relative to the reference line by a distance equal to the adjustment in height of the frame relative to the first traveling gear.

22. The method of claim 21, wherein step (e) comprises:

pivoting an elongated boom relative to the frame, the sensors being mounted on the boom; and maintaining a constant angular orientation of the boom relative to the reference line regardless of a pitch of the frame relative to the reference line.

23. The method of claim 22, wherein the maintaining step further comprises maintaining the boom parallel to the reference line.

* * * * *